US008311259B2

(12) United States Patent
Pinter et al.

(10) Patent No.: US 8,311,259 B2
(45) Date of Patent: Nov. 13, 2012

(54) IN-EAR EARPHONE

(75) Inventors: Bernhard Pinter, Moosbrunn (AT); Hannes Lehdorfer, Vienna (AT)

(73) Assignee: AKG Acoustics GmbH (AT)

( * ) Notice: Subject to any disclaimer, the term of this patent is extended or adjusted under 35 U.S.C. 154(b) by 740 days.

(21) Appl. No.: 12/402,101

(22) Filed: Mar. 11, 2009

(65) Prior Publication Data

US 2009/0232341 A1 Sep. 17, 2009

(30) Foreign Application Priority Data

Mar. 12, 2008 (EP) ..... 08450034

(51) Int. Cl.
*H04R 25/00* (2006.01)

(52) U.S. Cl. ..... 381/380; 380/322; 380/328

(58) Field of Classification Search ..... 381/312, 381/328, 380, 322
See application file for complete search history.

(56) References Cited

U.S. PATENT DOCUMENTS

| | | | | |
|---|---|---|---|---|
| 3,983,336 | A * | 9/1976 | Malek et al. | 381/313 |
| 4,972,488 | A | 11/1990 | Weiss et al. | |
| 5,692,059 | A * | 11/1997 | Kruger | 381/151 |
| 5,737,436 | A | 4/1998 | Boyden | |
| 2006/0133630 | A1 * | 6/2006 | Harvey | 381/312 |
| 2006/0133631 | A1 | 6/2006 | Harvey | |
| 2006/0133636 | A1 * | 6/2006 | Harvey et al. | 381/380 |
| 2007/0036385 | A1 * | 2/2007 | Harvey et al. | 381/388 |
| 2007/0201717 | A1 * | 8/2007 | Dyer et al. | 381/380 |
| 2007/0291971 | A1 * | 12/2007 | Halteren | 381/322 |
| 2008/0031481 | A1 * | 2/2008 | Warren et al. | 381/322 |
| 2009/0060245 | A1 * | 3/2009 | Blanchard et al. | 381/345 |
| 2009/0147981 | A1 * | 6/2009 | Blanchard et al. | 381/380 |
| 2010/0128905 | A1 * | 5/2010 | Warren et al. | 381/312 |

FOREIGN PATENT DOCUMENTS

| | | | |
|---|---|---|---|
| WO | WO 97/11574 | A1 | 3/1997 |
| WO | WO 2006/068772 | A2 | 6/2006 |
| WO | WO 2006/083834 | A2 | 8/2006 |

* cited by examiner

*Primary Examiner* — A. Sefer
(74) *Attorney, Agent, or Firm* — Brinks Hofer Gilson & Lione

(57) ABSTRACT

An earphone device converts electric signals to audible sound. The device includes an outer area configured to receive a power source. A plug area adjacent to the outer area may be configured to fit within a user's auditory canal. A dynamic transducer reproduces a predetermined frequency spectrum for the user. A sound channel terminating at an output of the dynamic transducer encloses the second transducer.

11 Claims, 9 Drawing Sheets

IN-EAR EARPHONE

BACKGROUND OF THE INVENTION

1. Priority Claim.

This application claims the benefit of priority from EP 08450034.7, filed Mar. 12, 2008, which is incorporated by reference.

2. Technical Field.

This disclosure relates to devices that convert one form of energy into another and particularly to systems that convert electric energy into non-electric energy.

3. Related Art.

Earphones convert electric signals into audible sound. They may compensate for impaired hearing, deliver music, radio programs, or be used to communicate with others. Many devices are worn behind or fit over a user's ear. Besides the discomfort and unsightly appearance, some devices over compensate for noisy environments by over amplifying sound at the outer ear.

SUMMARY

An earphone device converts electric signals into audible sound. The device includes an outer area configured to receive a source of power. A plug area adjacent to the outer area may be configured to fit within a user's auditory canal. A dynamic transducer reproduces a predetermined frequency spectrum for the user. A sound channel terminating at an output of the dynamic transducer encloses the second transducer.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

An earphone system converts electric signals into audible sound. The system includes devices that convert one form of energy into another. In some systems it may include a balanced armature (BA) transducer or a piezoelectric transducer. The transducer may be positioned in a plug area and may lie in a sound channel of a dynamic transducer (e.g., a device that may reproduce low and/or high frequency spectrum or aural sound). In some applications, the internal front volume of the earphone is reduced to about 40 $mm^3$ with the entire front volume reduced from about 815 $mm^3$ to about 713 $mm^3$.

In some earphones the acoustic outlet of the BA transducer (e.g., a transducer that may move less air than a dynamic transducer) is positioned adjacent to the acoustic outlet of a dynamic transducer. The acoustic outlet may be directed away from the end of the sound channel. High quality intelligibility is achieved because the earphone is less sensitive to leakage. Musical tones (e.g. tonality) may be reproduced fluidly, dynamically, and clearly through the dynamic transducer.

Figure 1:
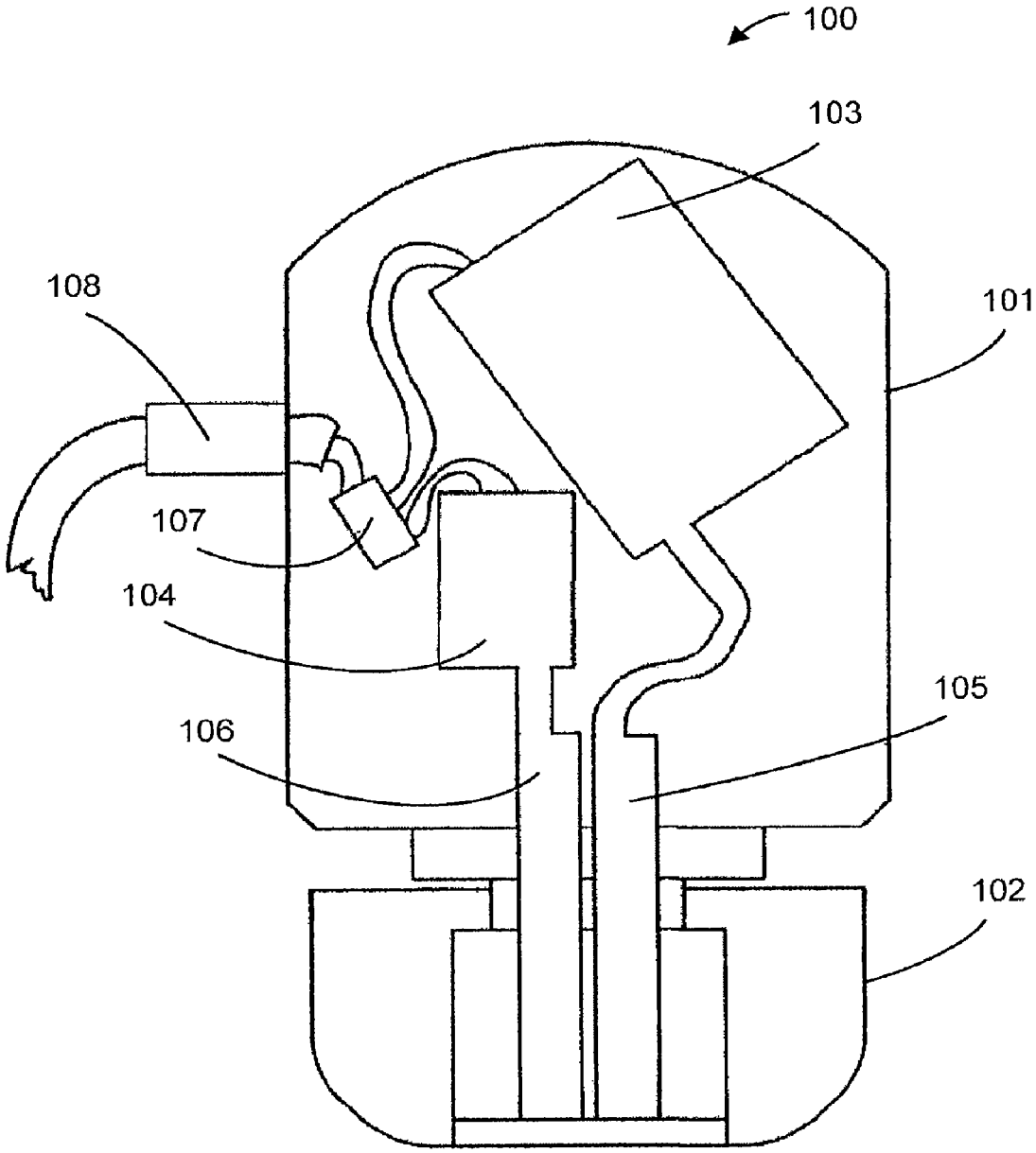
FIGURE 1 PRIOR ART
FIG. 1 is an earphone that may be partially worn within the ear.

FIG. 1 is an earphone 100 that includes a housing 101 and an ear cushion 102. The ear cushion 102 may be situated in the auditory canal. Two BA transducers 103 and 104 are exposed to signals through a frequency divider network 107. The BA transducers 103 and 104 transmit acoustic waves through sound channels 105 and 106, which are positioned substantially parallel and flow in the direction of the auditory canal. Power is sourced to the earphone 100 through a cable and a lead-through 108.

Figure 2:
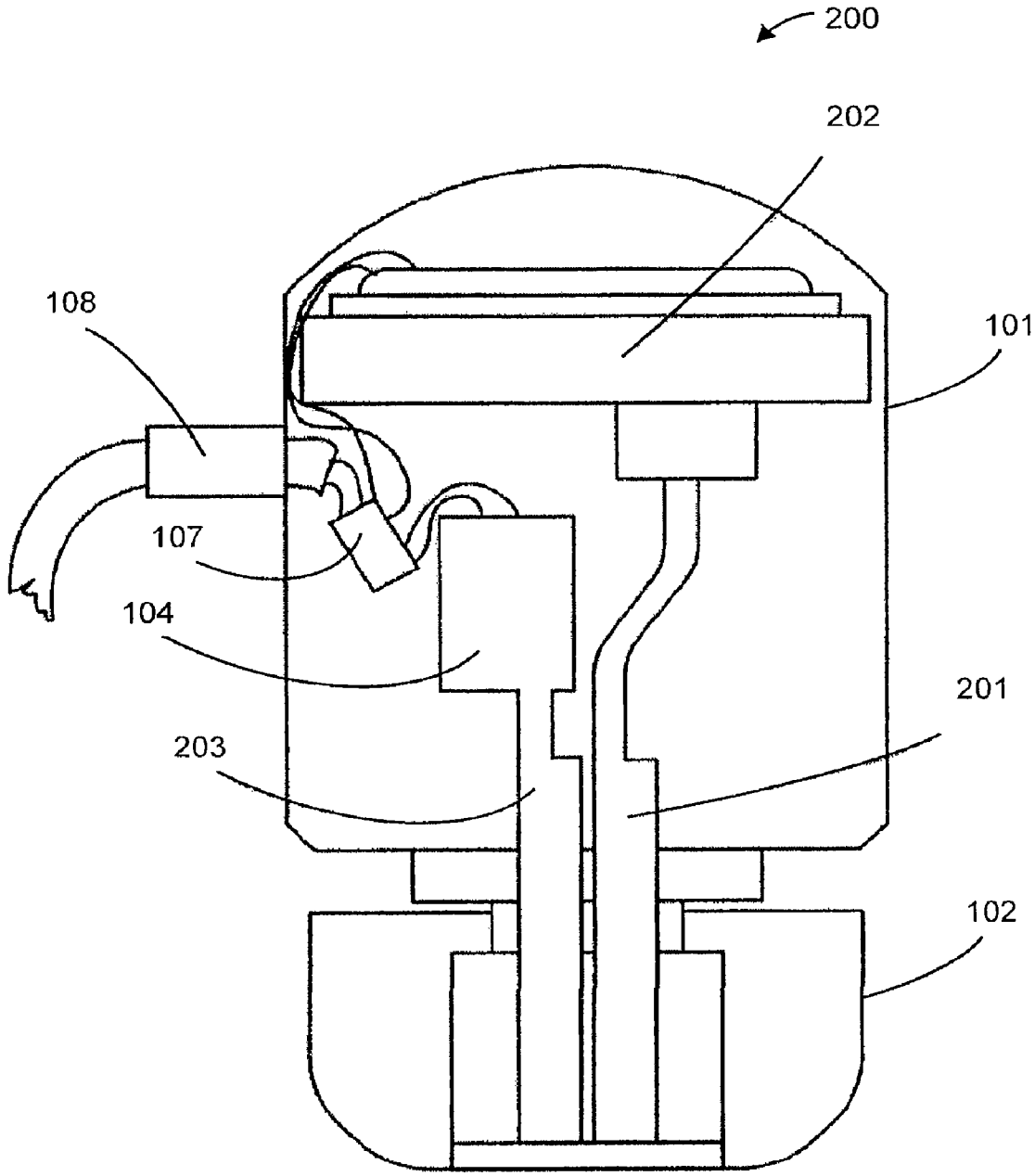
FIGURE 2 PRIOR ART
FIG. 2 is an alternate earphone that may be partially worn within the ear.
Figure 3:
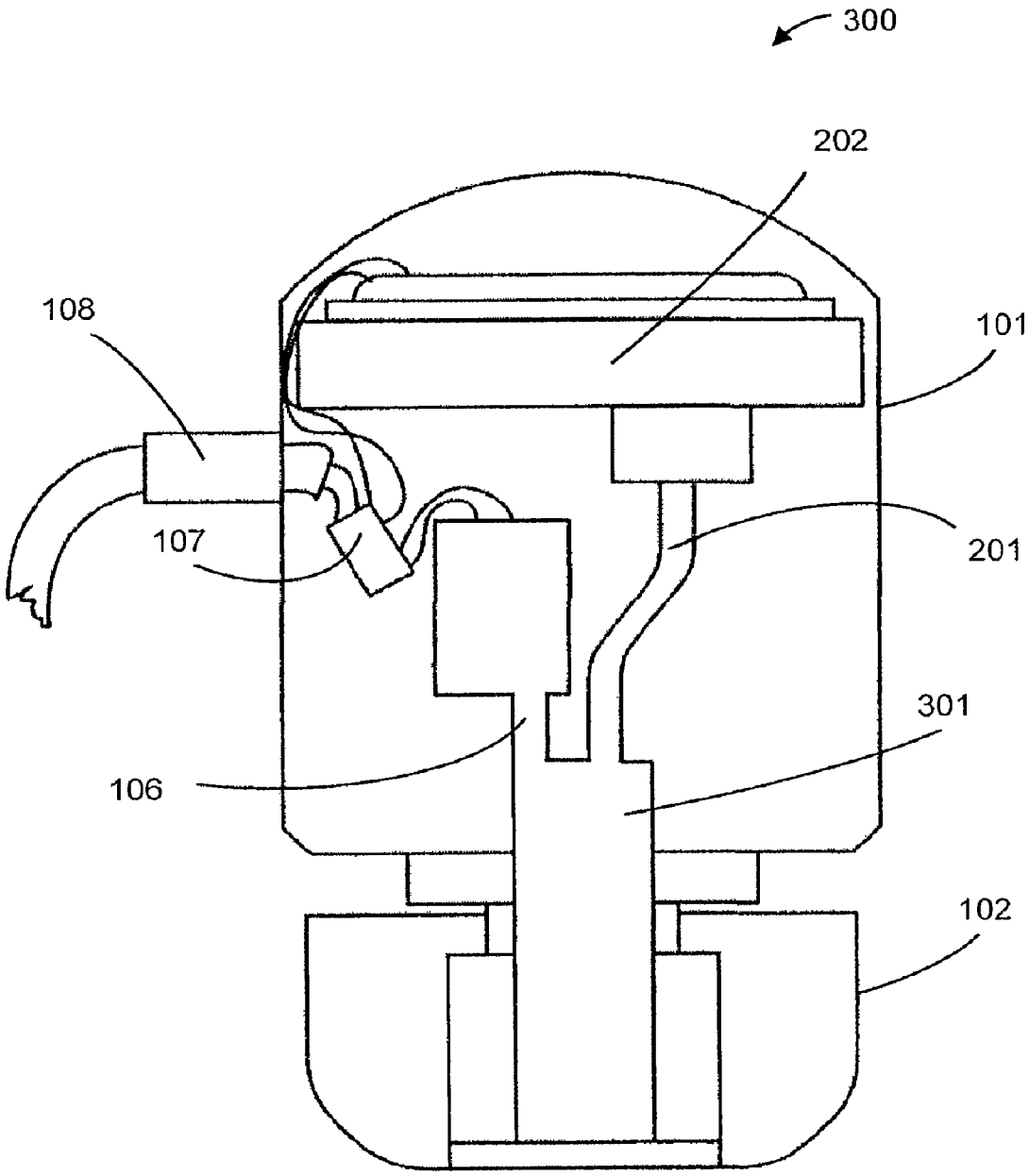
FIGURE 3 PRIOR ART
FIG. 3 is an alternate earphone that may be partially worn within the ear.

FIG. 2 is an alternate earphone system 200. In the earphone system 200 a BA transducer 104 communicates through sound channel 203. A dynamic transducer 202 communicates with a separate sound channel 201. In this system, the BA transducer 104 receives input from a frequency divider network 107. The sound channels 201, 203, are positioned in parallel and may be partially received by the auditory canal. FIG. 3 is an alternate earphone 300 having sound channels 106, 201 that terminate at a common end channel 301. The common end channel passes through the ear cushion 102 of the earphone 300.

Figure 4:
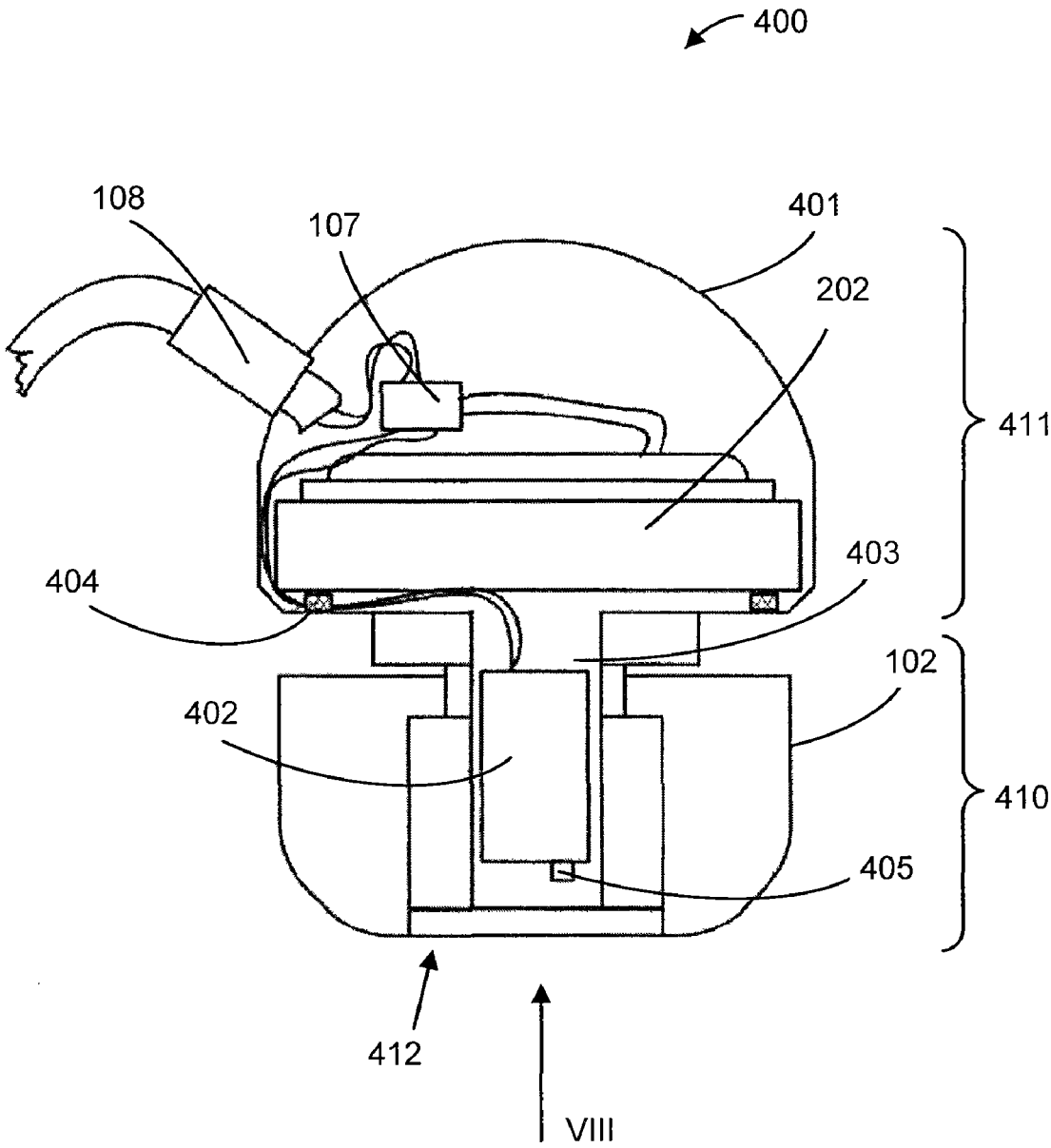
FIG. 4 is an in-ear earphone.

FIG. 4 is an in-ear earphone device 400. The earphone device 400 converts electric signals that may include telephone, stereo, or other transmitted signals to audible (or aural) sound. In the earphone device 400, a plug area 410 may be positioned in a narrow tube-like passage that terminates at the tympanic membrane (in the auditory canal). A notch or channel separates the plug area 410 from the outer area 411. The width and length of the separation established by the notch may vary with an application. In some alternate systems the plug area 410 and outer area 411 comprise a unitary element.

The earphone 400 includes a BA transducer 402 and ear (or air) cushions 102. When worn, the oval cylindrical shape of the auditory canal may receive the BA transducer 402 positioned in front of a dynamic transducer 202. Sound channel 403 also encloses the BA transducer 402. Miniaturization may be facilitated by the configuration of the transducers that are positioned to render a strong coincidence. In some systems, it is facilitated by a sound outlet 405 of the BA transducer 402 lying in a sound channel 403 of a dynamic transducer 202 (see also FIG. 8). The cavity or channel positioned "in front" of the dynamic transducer 202 may be sealed to form a closure against air (e.g., airtight) and other external elements thereby allowing the sound outlet 403 to serve as a sound channel. Control lines from the frequency divider network 107 may be guided to the BA transducer 402 by passing through a portion of the seal 404 or may not be used when wireless connections and other portable power sources are used. The sound opening 412 of earphone 400 and output of the BA transducer 402 may terminate at a proximal portion of the plug area 410. When worn, the sound opening 412 may face or communicate with the tympanic membrane.

Figure 5:
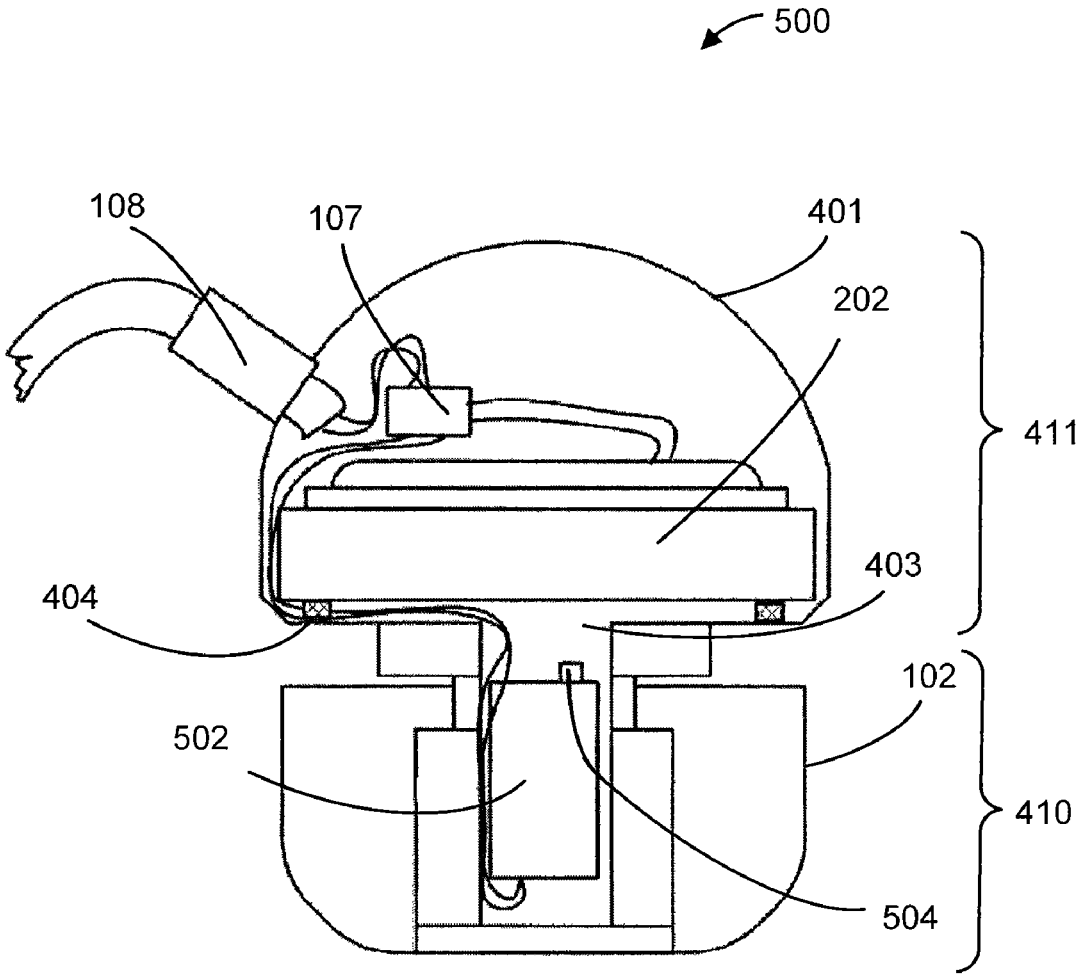
FIG. 5 is an alternate in-ear earphone.

FIG. 5 shows an alternative ear piece system 500. In FIG. 5, the BA transducer 502 lies in an "inverted" position. The sound outlet 504 may face an output of the dynamic transducer 202. In this system, the sound paths of the BA and dynamic transducers 202, 502 may be approximately the same size. Similarly sized sound paths may improve coincidence and sound quality.

Figure 6:
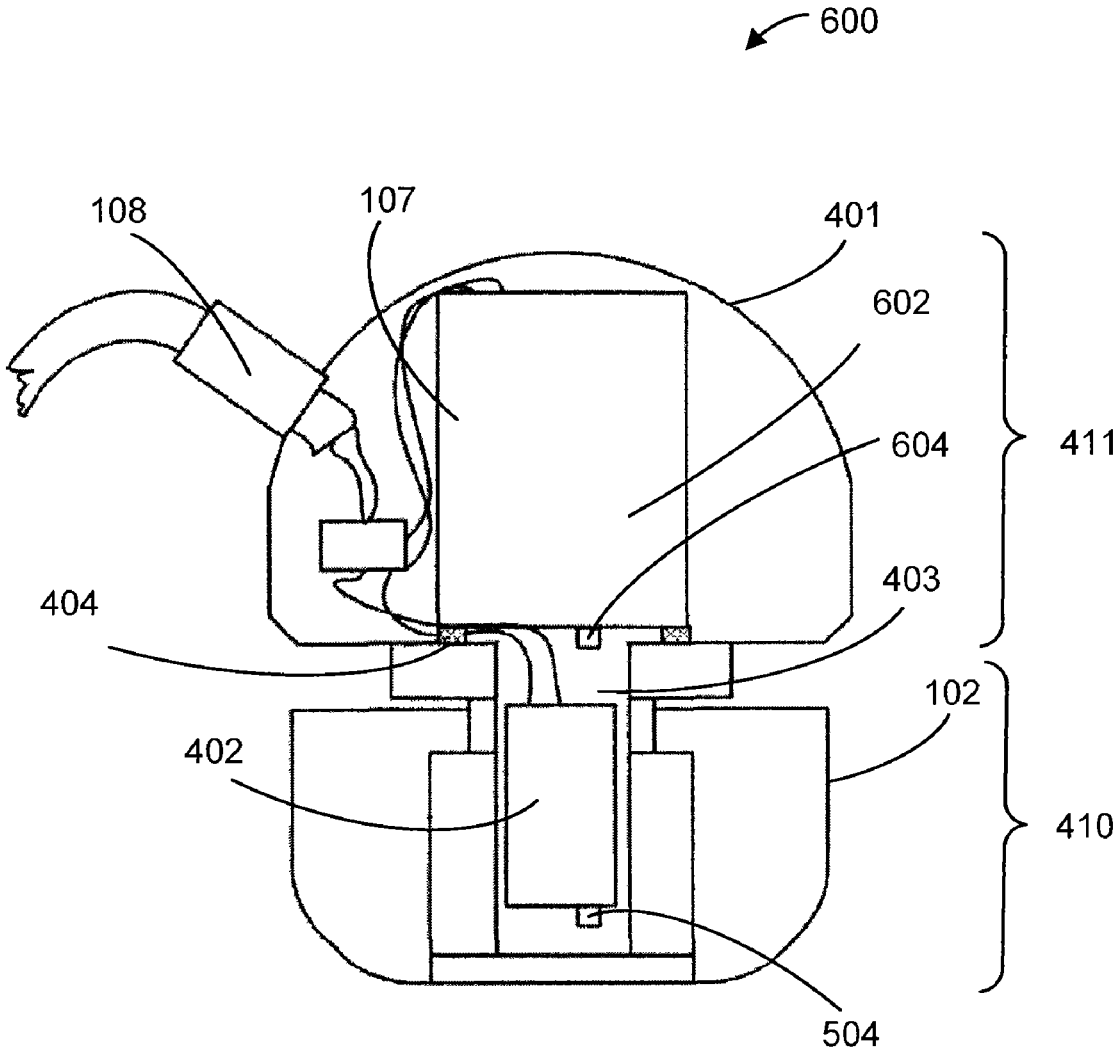
FIG. 6 is an alternate in-ear earphone.

FIG. 6 is an alternate ear piece that includes two or more BA transducers (402 and 602 are shown). A sound outlet 504 of BA transducer 402 may be directed toward or face a distal end of BA transducer 602. In this arrangement the sound outlets 504 and 604 may face or be directed to the proximal end of the earphone system 600.

Figure 7:
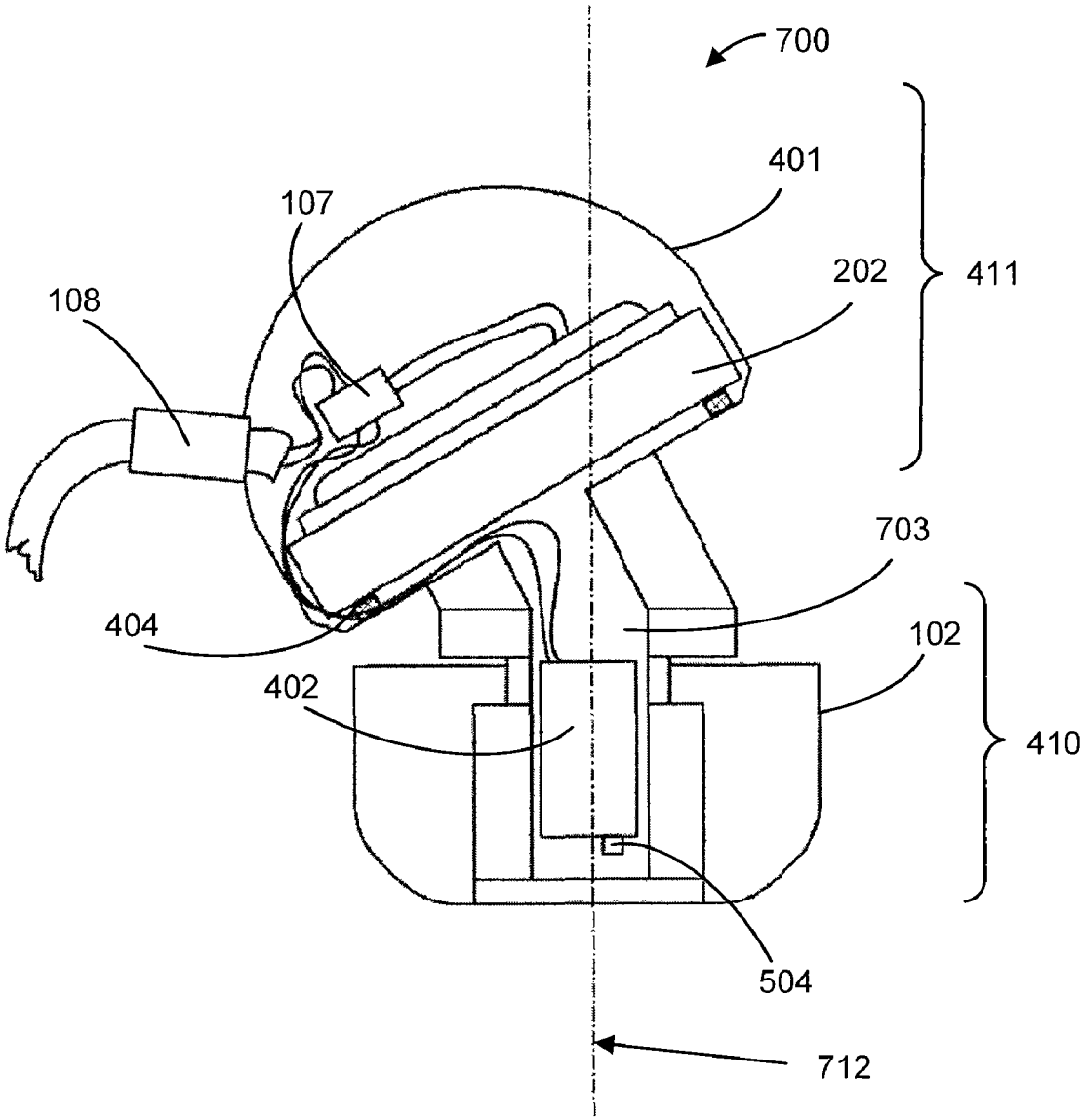
FIG. 7 is an alternate in-ear earphone.

FIG. 7 is an ergonomic earphone system 700. The earphone system 700 includes a dynamic transducer 202 inclined or oblique to a central axis 712 of the BA transducer 402. The central axis 712 may form a line of symmetry to the ear cushion 102. A common arcuate flexible sound channel 703 may diverge from the central axis 712. In FIG. 7, the line of symmetry of the sound channel forms an obtuse angle with the line of symmetry (e.g., central axis 712) of the BA transducer 402. A portion of the arcuate transition may be coincident with the oval cylindrical canal of a user's auditory canal.

The flexibility and configuration of FIG. 7 may improve comfort without reducing sound quality. In some alternate systems, the BA transducer may be positioned in an inverted position in which the sound outlet 504 of transducer 402 may be directed toward an output of the dynamic transducers 202. In this arrangement, coincidence may improve.

Figure 8:
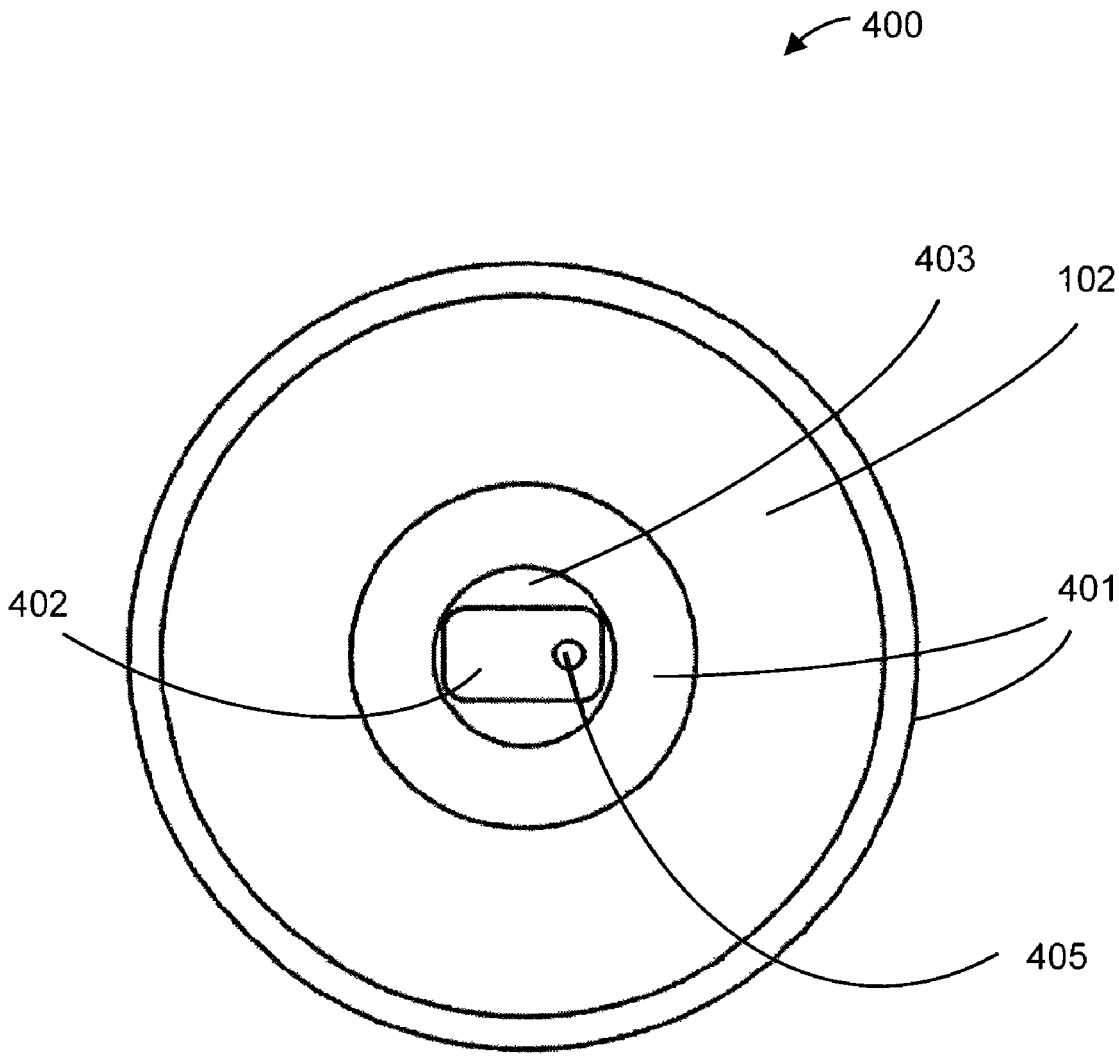
FIG. 8 is a top view of a transducer of FIG. 4.

FIG. 8 is a top view of FIG. 4 in from the direction of arrow VIII. In FIG. 8 the sound channels of the transducers 402 and 202 are coincident. The BA transducer 402 is enclosed by the sound channel 403, ear cushion 102, and housing 401. The sound outlet 405 of BA transducer may be visible in the area of a central recess of the air cushion.

Figure 9:
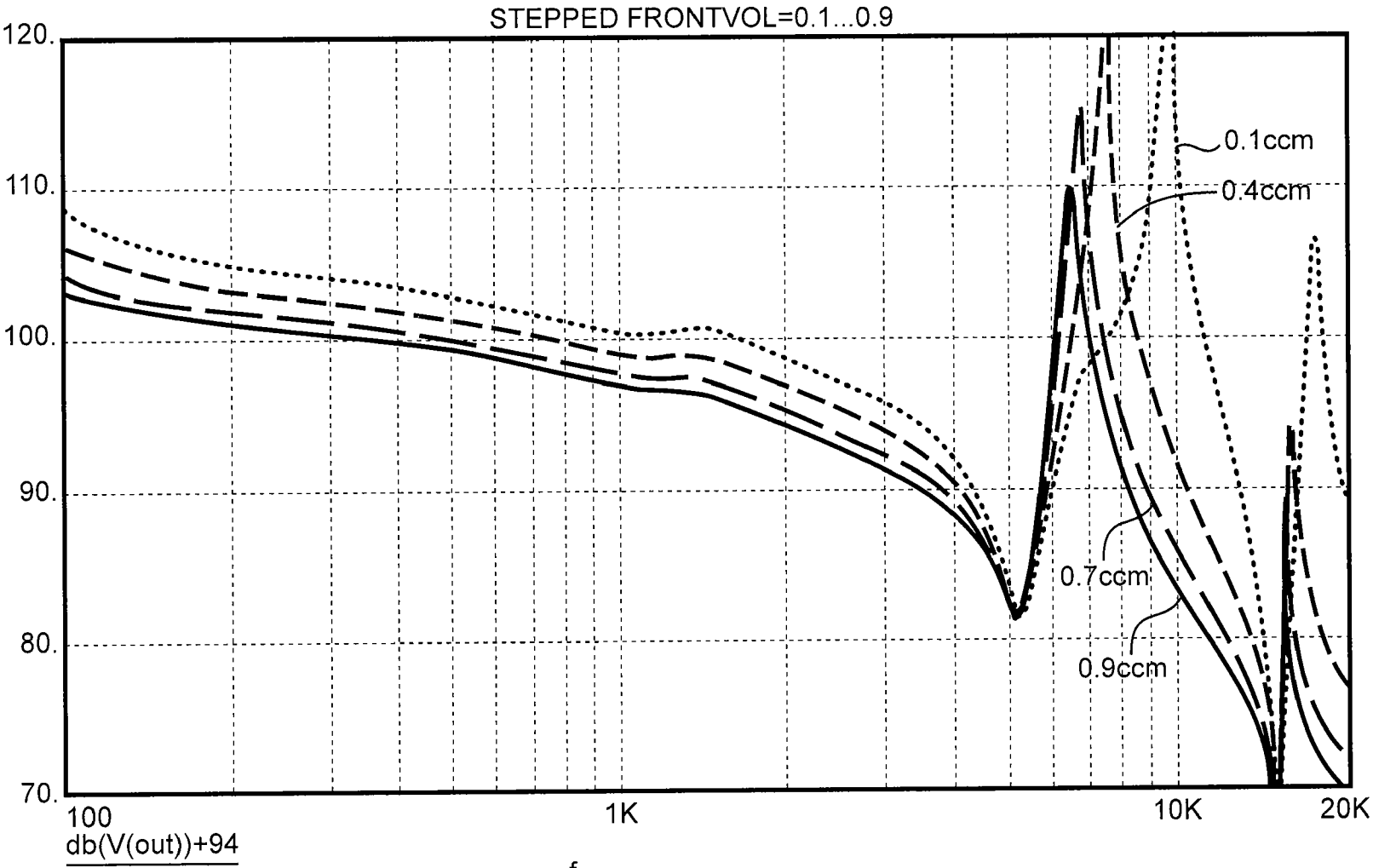
FIG. 9 shows a comparison of the characteristics of the earphone based on an equivalent circuit.

FIG. 9 illustrates the emitted sound pressure simulated in an artificial ear. Four curves that correspond to front volumes of 0.1 $cm^3$, 0.4 $cm^3$, 0.7 $cm^3$ and 0.9 $cm^3$ are plotted on a logarithmic scale against the frequency between about 100 Hz and about 20 kHz. The maxima of the curves that form at the resonance frequency are shifted to higher frequencies at smaller front volume showing the improvement when compared to known devices.

Other alternate systems may include combinations of some or all of the structures described above or shown in the figures. These systems may be formed from any combination of structure or functions described. In some systems different transducers are used and dimension may vary. For example, some alternate earphone systems use three or more transducer having outputs facing a common direction or some or all aligned in inverted positions. The shape of the sound channels that may lie in a listener's auditory canal may enclose two, three, or more transducers (e.g., BA, dynamic, etc.). In some systems only a subset of the first transducer, the second transducer, and the third transducer may lie in a common channel or within a user's auditory canal. The shape of the channel may vary. Other alternate systems (including those shown) may not include or interface a frequency divider network and some or all of the transducers may be connected in parallel.

Each of the systems described may include special sound outlet openings. When a transducer is arranged in a plug area 410 of the earphone, it may face corresponding second transducer (or third, or fourth, or fifth, etc.). These arrangements may improve coincidence.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. An earphone device that converts electric signals into audible sound comprising:

an outer area configured to receive a power source;

a plug area adjacent to the outer area configured to fit within a user's auditory canal;

a dynamic transducer that reproduces a predetermined aural frequency spectrum;

a sound channel terminating at an output of the dynamic transducer and a proximal end of the plug area; and a second transducer positioned within the sound channel.

2. The earphone device of claim 1 where the second transducer comprises a piezoelectric element.

3. The earphone device of claim 1 where the second transducer comprises two or more balanced armature transducers.

4. The earphone device of claim 1 where the second transducer comprises a balanced armature transducer.

5. The earphone device of claim 4 where a sound outlet of the dynamic transducer is positioned directly adjacent to a sound outlet of the balanced armature transducer.

6. The earphone device of claim 4 in which a line of symmetry of the second transducer forms an obtuse angle with a line of symmetry of the sound channel.

7. The earphone device of claim 4 where a sound outlet of the second transducer lies directly adjacent to an opening of the earphone that transmits the audible sound to the user's tympanic membrane.

8. The earphone device of claim 4 where a sound outlet of the dynamic transducer faces a sound outlet of the balanced armature transducer.

9. The earphone device of claim 8 where the dynamic transducer is configured to be positioned outside of the user's auditory canal when the plug area is positioned within the user's auditory canal.

10. The earphone device of claim 1 in which a line of symmetry of the second transducer forms an obtuse angle with a line of symmetry of the sound channel.

11. The earphone device of claim 1 where an output of the second transducer lies directly adjacent to an opening of the earphone that transmits the audible sound to the user's tympanic membrane.

* * * * *